US011091841B2

(12) United States Patent
Kounadinis

(10) Patent No.: US 11,091,841 B2
(45) Date of Patent: Aug. 17, 2021

(54) AUTONOMOUS IMPRESSED CURRENT CATHODIC PROTECTION DEVICE ON METAL SURFACES WITH A SPIRAL MAGNESIUM ANODE

(71) Applicant: Nikitas Kounadinis, Attikis (GR)

(72) Inventor: Nikitas Kounadinis, Attikis (GR)

( * ) Notice: Subject to any disclaimer, the term of this patent is extended or adjusted under 35 U.S.C. 154(b) by 307 days.

(21) Appl. No.: 16/317,066

(22) PCT Filed: Jul. 11, 2017

(86) PCT No.: PCT/GR2017/000039

§ 371 (c)(1),
(2) Date: Jan. 11, 2019

(87) PCT Pub. No.: WO2018/011608

PCT Pub. Date: Jan. 18, 2018

(65) Prior Publication Data

US 2019/0226095 A1 Jul. 25, 2019

(30) Foreign Application Priority Data

Jul. 14, 2016 (GR) ..... 2016100387

(51) Int. Cl.
*C23F 13/16* (2006.01)
*C23F 13/10* (2006.01)
*C23F 13/06* (2006.01)

(52) U.S. Cl.
CPC ..... *C23F 13/16* (2013.01); *C23F 13/06* (2013.01); *C23F 13/10* (2013.01); *C23F 2213/31* (2013.01)

(58) Field of Classification Search
CPC ..... C23F 13/02; C23F 13/06; C23F 13/08; C23F 13/10; C23F 13/16; C23F 2201/00–2201/02; C23F 2213/20; C23F 2213/30–2213/32
See application file for complete search history.

(56) References Cited

U.S. PATENT DOCUMENTS 2,487,499 A * 11/1949 Webb ..... H01M 10/0431 429/94
2011/0123875 A1* 5/2011 Issaev ..... H01M 4/382 429/338

FOREIGN PATENT DOCUMENTS

GR 20090100454 B * 8/2009 ..... C23F 13/06

OTHER PUBLICATIONS

GR 20090100454 B Translation (Year: 2020).*

* cited by examiner

*Primary Examiner* — Alexander W Keeling

(57) ABSTRACT

An autonomous impressed current cathodic protection device utilizes a spiral layout of materials, with a magnesium sheet placed in parallel with a copper sheet, and a foamed material in between as insulation, all placed in a plastic container and solidified after inert fluid material is poured in. At a center of the spiral layout, a magnesium anode core is connected through a wire to the surrounding spiral layout. The device can generate electrical voltage of up to −1.7 volt with increased amperage of up to 500 mA. The presented layout of the materials and components allows for increased flexibility concerning the manufacturing of devices based on the requirements of industrial applications, construction sites, and various needs and demands in marine applications for ships, regardless of size.

10 Claims, 3 Drawing Sheets

AUTONOMOUS IMPRESSED CURRENT CATHODIC PROTECTION DEVICE ON METAL SURFACES WITH A SPIRAL MAGNESIUM ANODE

BACKGROUND OF THE INVENTION

This invention is a modification of an existing autonomous cathodic protection device which has been copyrighted with the Diploma number 1007131 since 2009.

Electrolysis is a naturally occurring phenomenon with an erosive effect on both metals and metal alloys. It has been known to corrode metallic structures, installations, industrial equipment etc., whose construction required significant expenditure.

Therefore, their protection and maintenance is deemed necessary. However, this procedure is also not cost effective.

Less drastic metals are known to absorb ions from more drastic metals. Over time, this phenomenon causes huge corrosion on all metal surfaces. As a result, it is imperative that the installations be protected for the duration of their operational life.

During the corrosive process on non-protected metal surfaces, electrical voltage is produced among different metals being connected to each other, provided they are placed in a common humid environment. This electrical voltage is the transferring of ions in the form of electrons from more drastic metals to less drastic ones.

This voltage is specific for each kind of metal and any differentiation changes the behavior of the entire installation. That is to say, if there is a sequence of connected metals such as iron alloys and aluminum in pipes being run by water, then ions are transferred from aluminum to iron, thereby causing electrolysis and aluminum corrosion. In this particular example, the transferring of ions is through the form of electrical voltage DC, amounting to 900 millivolts (mV).

If voltage higher than 900 mV is imposed, then the electrolysis phenomenon is prevented. Given that we are dealing with DC, the negative prefix (−) is important when it comes to imposing impressed current. In brief, if we impose −1000 mV voltage the phenomenon is stopped.

The prevention of the electrolysis phenomenon is therefore achieved when we impose voltage both higher than the one produced between metals and with higher current density.

Cathodic protection offers several benefits with regard to preventing the electrolysis phenomenon as well as its consequences, reducing the corrosive effects and maintaining the installations.

For the cathodic protection to be considered reliable, we must achieve a positive result in both preventing the corrosion and ensuring long term protection.

SUMMARY OF THE INVENTION

The device in question can be applied to any given complex of metal installations, equipment/network, tanks etc., imposing −1.6 volts (V) in DC with a negative prefix. This results in installations being negatively charged, thereby not shedding ions from their mass and preventing oxidation at a surface level. This voltage is more than efficient since it can overcompensate all the arising differences in potential which might occur in all metal structures by electrolysis between the metals themselves and not by external factors.

The imposed current is produced by the transferring of ions due to the difference in potential between the magnesium mass and the second electrolytic pole (copper coating). The current is DC and compatible with other metals, since it is naturally generated.

The negative charging of the protected metals is completely satisfactory, resulting in the surface which used to be an anode of galvanic element (i.e. negative oxidizing pole) becoming a cathode of electrolytic cell (i.e. negative reducing pole).

The protected surface remains negatively charged but its action is reversed, and is now inclined to undergo reduction instead of oxidation.

The connectivity of the device is simple and its application does not require any specialized knowledge. The device itself comes with two wires, (see FIG. 3) one of which emerges from the upper part of the device (21) and is connected to the installation to be protected. The second wire emerges from the side part (19) and is led to a grounding electrode which is planted into the ground (20) near the device and its installation point.

Given that the metallic surfaces vary significantly (cast iron, stainless steel, metal alloys) in kinds as well as surface areas, the current density which must be imposed fluctuates, because the larger the area we wish to protect, the more density is required.

So the new device is improved since it is capable of protecting surfaces ranging from 50 square meters ($m^2$) up to 250 $m^2$ which differs according to the kind of intervening metals.

The produced current density can now reach more than 500 milliampere (mA) per device, as previously mentioned.

As a rule, the common requirements of imposing 1.7 V of negative voltage on metal surfaces range from over 2 up to 5 $mA/m^2$ of current density. These values are the result of studies and are true for the majority of metal structures. Each device can therefore protect from 100 $m^2$ up to 250 $m^2$ of metal surface.

The current density is a very important factor since it is reduced after being applied due to the resistance according to Ohm's Law. Specifically, the larger the area to be protected from electrolysis, the greater the resistance.

The device we refer to produces low electrical voltage which is extremely efficient for cathodic protection and can be applied through a wire to any installation points we wish to protect.

This particular voltage is produced in the same way electrolysis works (i.e. difference in potential between two metals), rendering it completely compatible. This compatibility of the impressed current is one of the determining factors contributing to the success of this application.

Each metal has a limit of potential difference and based on the table of the galvanic series for common metals we can see that comparing not only common and non-precious metals but also iron based metals we conclude that the more active one is magnesium. In fact, it can produce up to −1700 mV as opposed to copper (the second electrolytic pole) which is the least active metal.

The exclusion of precious metals is obviously due to economic reasons since this is a low cost application because it is considered expendable. Non-iron based metals are also not used because they are more active.

Therefore, we can determine the method of producing the desired voltage but we also need to take into account the current density which is the second component for the successful application and efficiency of the device.

This method results in improved uniformity and overlapping of the metals, achieving long term protection of larger surfaces. What is more, there is a reduction in the number of application connections, reducing the overall cost involved.

According to the present method of anode layout within the device itself, we can achieve a voltage output of approximately −1700 mV DC and density of up to/more than 3 years with steady output.

The produced current is a product of the difference in potential between the magnesium anodes and the copper casings placed in a spiral form. This spiral layout offers improved output because the surface area of the anodes is significantly larger than the one of individual pieces. Also, the magnesium in a sheet form and the copper in a sheet form complement each other much more effectively than individual magnesium pieces placed around the perimeter of the plastic container.

Therefore, the devices impose consistent voltage in conjunction with increased amperage in order to protect a larger metal surface for as long as possible.

The fact that these devices utilize magnesium metal as a power source in its proposed structure and construction allows it to last for a time period ranging from 3 up to 5 years. This is definitely an added ecological advantage, economizing on raw materials, given that replacing the devices is required over an extended time frame.

A further application with excellent results is offering cathodic protection in the marine sector.

Ship hulls and external metal surfaces are commonly protected by sacrificial zinc and aluminum anodes. However, the engine room and other mechanical installations can be perfectly protected by these devices, provided that the grounding electrode is modified accordingly so that it can be connected to the sea water network.

To sum up, the following is a list of the benefits offered by applying these devices:

- Power autonomy, since no connection to an external power supply is necessary.
- This is a disposable/non reusable device, meaning that when the anode mass is exhausted, the device is no longer functional and needs to be replaced by a new one.
- It is environmentally friendly, given that it protects from oxidation and does not produce any waste.
- It does not raise any safety concerns for either humans or animals because of the low voltage generated.
- It is not affected by external factors, or by weather conditions.
- It does not affect the surrounding area in any way whatsoever.
- It offers added health related benefits, since during operation it does not come into contact with the contents of the networks, tanks, piping which may contain either food or drinking water.
- The output of the device does not fluctuate but remains consistent throughout its operational life.
- The time frame of the protection is adjustable, since the device can be manufactured based on specifications offering both short and long term protection.
- The increased produced density renders the device an economical solution.

Actually, fewer devices meaning less expenditure can offer protection of larger metal surfaces.

- The device can be used by the general public without requiring any specific or specialized technical knowledge. Its installation and replacement is also an easy process.
- The devices do not require any kind of tampering neither for maintenance nor for repair during their operational life.
- The installations to which the devices will be connected do not need any kind of preparation or modification.
- The device can be applied with excellent results to a wide range of installations, such as industrial applications, the marine sector, the construction sector etc.
- The cost vs. effectiveness ratio is no doubt favorable, offering both immediate and long term benefits.
- The cathodic protection is totally compatible with metals, since the voltage is generated in a natural way from one of the more active metals.

BRIEF DESCRIPTION OF THE SEVERAL VIEWS OF THE DRAWINGS

The invention will be better understood in with reference to the following.

DETAILED DESCRIPTION OF THE INVENTION

Figure 1:
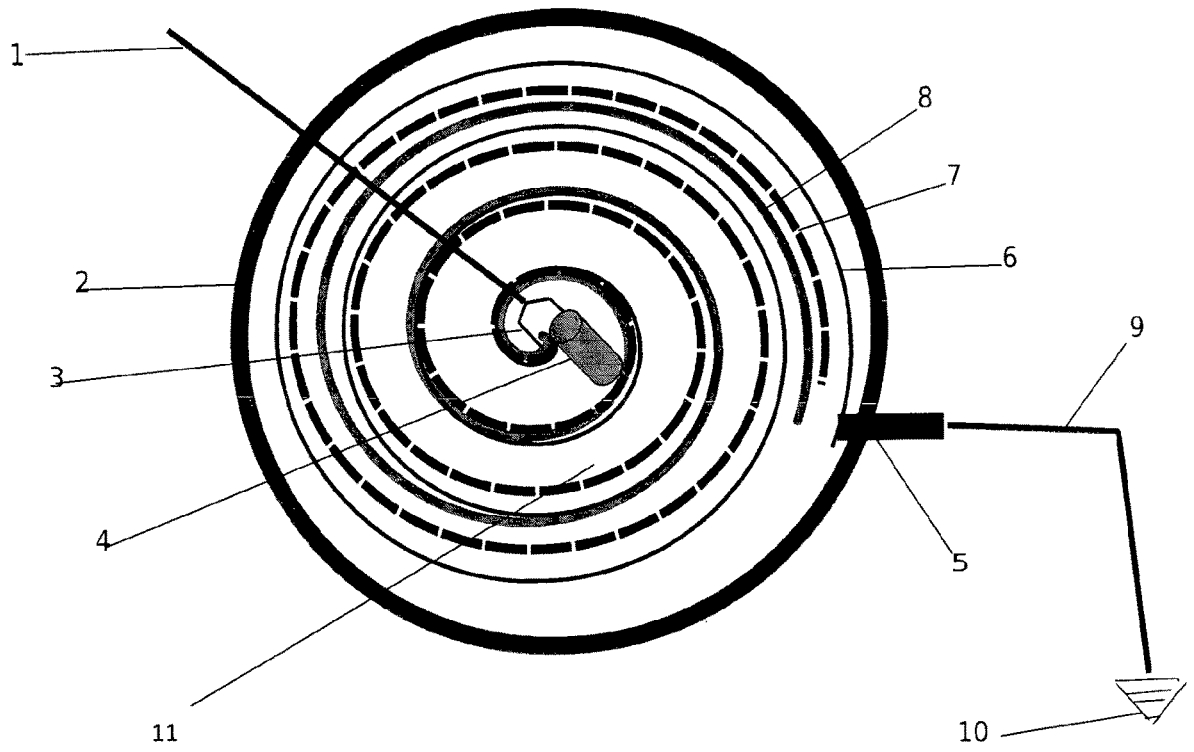
FIG. 1 is a top view of a device according to an embodiment of the present invention.

Figure (1) shows the top view of the device inside a plastic container (2). The device consists of:

A central magnesium anode core (4) placed in the center whose upper side is attached to a connection point (1) of the device to the installations. This connection point is led to a local loop connection through a bridge wire (3) which connects the core (4) with the magnesium sheet (8) placed around the perimeter in a spiral manner.

In parallel with the magnesium sheet (8), there is a copper sheet (6) of identical dimensions also placed in a spiral manner. This layout creates the second electrolytic pole in order to produce the difference in potential within the device itself.

Between the two metals, a soft porous material (foam rubber) (7) of identical dimensions is placed. This allows for insulation between the two metals, s constant short distance between them, permeability of ions between the metals and preservation of the necessary level of humidity for the transfer of ions. Furthermore, the foam (7) absorbs the effects of contraction and dilation of the materials due to variations in temperature. Finally, over the life span of the device, the magnesium are is expanded as a result of the process through which the original metal form is gradually turned into magnesium' oxide and salt, whose combined volume is approximately three times the volume of its original metal form. These waste by-products are absorbed by the foam (7).

The aforementioned material/component layout is placed within a plastic container (2) and then the inert material (11) (plaster etc.) is poured in fluid form so as to fill all the remaining gaps inside the device.

Onto the side part of the container, there is a metal screw type terminal (5) which is attached to the copper sheet (6) inside the container.

Figure 2:
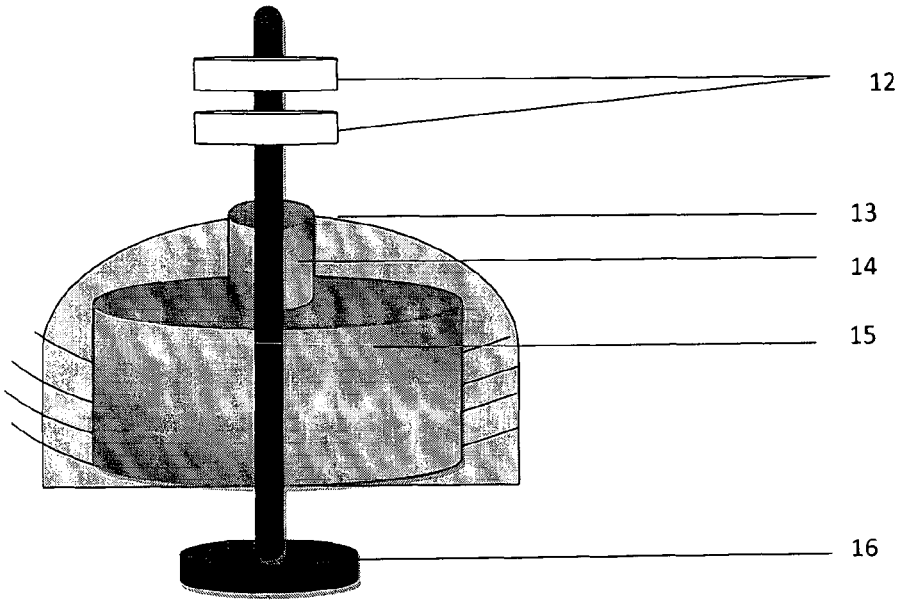
FIG. 2 is a side view of an embodiment of the device for marine applications.

This side terminal is connected to a grounding electrode (10) through a wire (9) and it is planted into the ground where the device will be utilized. To achieve the corresponding result in marine applications, the grounding electrode must be installed in a ship sector which is always into contact with sea water. (As described in FIG. 2). The intervention point is a pipe which is run by sea water.

Technical Specifications

A device producing low voltage DC current derived from the difference in potential between metals. This current is impressed on metal surfaces and installations and prevents the emergence of the electrolysis phenomenon.

The produced current can reach up to 1.6 V DC and it is imposed with a negative prefix (−).

The amperage ranges from 50 mA up to 500 mA.

The service life of the device is approximately 5 years after installation.

The device is disposable, it cannot be repaired, and it is replaced by a new one when it reaches the end of its service life.

Materials Required for the Product Manufacture

Exit cable (1) (FIG. 1) for connection to the protected surface. This wire is unipolar, multi strand, flexible and its diameter depends on the size of the device ranging from 6 up to 25 square millimeters ($mm^2$).

Bridge cable (3) of central magnesium anode core and spiral magnesium sheet. From the anodes up to the loop connection with the exit cable of the device, this wire is unipolar, multi strand, flexible and its diameter depends on the size of the anodes ranging from 2.5 up to 10 ($mm^2$).

Central magnesium anode core (4) (first anode pole) from magnesium metal of purity 99.9 percent (%) up to 99.95% and fluctuating dimensions according to the desirable size of the device from 25*25*80 millimeters (mm) up to 50*80*250 mm. This is also the mass of the magnesium of the central core which is determined by calculating the desired service life of the device and the desired density of the impressed current.

Magnesium sheet (8) (second anode pole) of thickness ranging from 2 up to 5 mm, length ranging from 800 up to 1500 mm and width ranging from 80 up to 250 mm, depending on the size of the device. This is also the mass of the magnesium which is determined by calculating the desired service life of the device and the desired density of the impressed current as in paragraph 3.

Inert material (11) based on plaster 90% with the addition of bentonite and sodium bicarbonate up to 10% in order to preserve moisture, to solidify the components and materials inside the device as well as to facilitate the flow of ions from the magnesium anodes to the cathodes (circular copper sheets). This mixture is poured into the container in a fluid form in a way that allows it to penetrate into all the points and materials of the device in a uniform manner, covering the entire height of the materials but without engulfing them entirely.

Foamed, soft, spongy material (foam rubber) (7) with fluctuating dimensions depending on the size of the device and of thickness ranging from 10 up to 30 mm and length as well as width equal to the magnesium sheet (1) so that it stands between the magnesium and copper (6) acting as insulation. The presence of this material acts as a water and moisture reserve, both of which are necessary so that ions can flow normally from the anodes towards the cathode. Furthermore, it stabilizes the components and materials of the device and absorbs the dilations of the inert material as it expands due to the deterioration of the anodes over time, which also creates magnesium oxides and salt.

Copper sheet (6) (second cathodic pole) from copper metal of 99.9% purity, of width ranging from 0.10 up to 0.25 mm, as well as length and width same as the magnesium sheet (1) and the foamed material (7).

All the components are placed within a plastic container (2) of corresponding size.

The grounding electrode (10) to be buried into the ground is metallic, made from cast iron, copper or titanium with dimensions of 8 mm up to 20 mm diameter and length ranging from 120 mm up to 250 mm depending on the device.

The grounding electrode to be used in marine applications consists of a screw plug (13) (in FIG. 2) whose diameter ranges from ½ of an inch up to 4 inches. The screw plug has a mounting hole on the top side whose size depends on the diameter of the titanium rod (16) ranging from 4 mm up to 8 mm and length from 50 mm up to 130 mm. This rod is also insulated (14 & 15) so that it does not come into direct contact with the plug which is screwed with a thread in order to be water tight. The upper part of the electrode titanium rod protruding from the plug has a screwed thread with bolts (12) to connect the cable coming from the side of the device (9) (FIG. 1). The bottom part of the electrode titanium rod is rotated spirally and helically from the center towards the outer rim to the point allowed by the size of the plug's internal perimeter.

Manufacturing Process

We assemble a set consisting of successive layers of sheets as follows:

We lay down a copper sheet which has been precut in the following dimensions (100 mm width/9100 mm length). The thickness is 0.12 mm.

On this particular sheet we place a sheet of foamed material (thickness 10 mm) of the same dimensions.

The next step is laying down a magnesium sheet (thickness 20 mm) of the same dimensions.

Finally we place a sheet of foamed material as described above.

All these materials are then rotated, creating a single roll with at least three coils.

This resulting roll is placed within a plastic container. The external view of the roll is the copper sheet which comes into contact with the plastic container. Midway through the height of the plastic container and near the edge of the copper sheet we securely attach a grounding terminal.

From the upper part of the container and in the center of the roll we plant a magnesium rod (core) and fix it into position without coming into contact with any other metal component.

A short wire coming from the central magnesium core is then bridged and connected to the magnesium sheet roll. Midway through the length of this bridging wire we place a loop, to which we attach another wire meant to be connected to the installations themselves.

After all the components and materials have been placed within the container, a mixture of inert material in fluid form is poured into the container so that it can permeate all over the components. Shortly afterwards, this inert material is solidified and stabilizes all the materials. Furthermore, when the mixture is fully solidified, we supplement as much water as the foamed material can absorb.

From this moment onwards, the device is fully functional.

Example of Device Application

An example of the application of this device is a water supply pipeline. We calculate the manufacture of the anodes based on the diameter of the pipe, its length as well as the desirable protection timeframe.

We know that the performance of the magnesium metal according to international standards is 1200 ampere hours per kilogram (AH/kg) mass and metal purity 99.9%.

Figure 3:
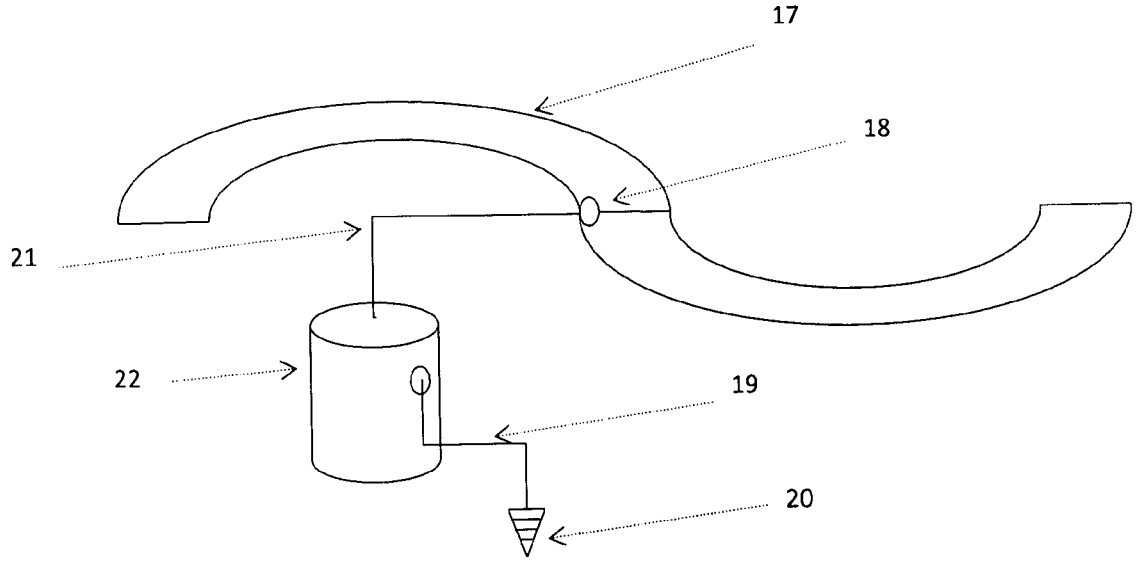
FIG. 3 is an illustration of an embodiment of the device attached to a pipeline.

We also know the total length is 500 meters (m) of steel pipeline (FIG. 3) and its diameter is 500 mm. This data equals a metal surface of 785 square meters.

We also choose the necessity for current density to be impressed to be 3 $mA/m^2$.

We also take into account a protection time frame of 3 years.

We then calculate 365 days*3=1095 days*24 hours=26280 hours*3 mA=78840 mA/H/1000=78,840 A/H*785 m=61889 AH/1292=47.9 kg of magnesium metal is the amount required for this particular installation.

If we utilized anodes based on the specifications of the U.S. Pat. No. 1,007,131, we would have to manufacture a total of about 26 devices which would have to be distributed along the pipeline length.

Utilizing the presented alternative specification would result in the need for 7 devices to be spread out. The reason is the output of increased current density which means fewer devices for the same installation requirements. Additional benefits include economizing on both the initial outlay and the maintenance inspection expenses involved.

The invention claimed is:

1. An autonomous impressed cathodic protection device, comprising a central magnesium anode core 4;

a spiral structure comprising a magnesium anode sheet 8, a copper sheet 6, and a foamed material 7 all formed in a spiral pattern with the foamed material positioned between the magnesium anode sheet and the copper sheet to maintain a constant distance between the magnesium anode sheet and the copper sheet along the spiral structure, the foamed material acting as an electrical insulator and a waste absorber;

a plastic container 2;

a connection wire 1 secured to both the central magnesium anode core and the magnesium anode sheet, the connection wire extending from the plastic container and attachable to a protected surface; and a terminal 5 secured to the copper sheet, the terminal attachable to a grounding apparatus, wherein the central magnesium anode core and the spiral structure are positioned inside the plastic container, the spiral structure extending around the central magnesium anode core without directly contacting the central magnesium anode core, and an inert material fills a remaining hollow space within the plastic container and between the central magnesium anode core and the spiral structure.

2. The autonomous impressed cathodic protection device of claim 1, wherein the magnesium anode sheet and the copper sheet have identical dimensions, and the magnesium anode sheet forms an innermost layer of the spiral structure and the copper sheet forms an outermost layer of the spiral structure, and the spiral structure forms more than three coils around the central magnesium anode core.

3. The autonomous impressed cathodic protection device of claim 1, wherein a grounding wire is connected to the terminal and to a metallic grounding electrode, the metallic grounding electrode insertable into a ground.

4. The autonomous impressed cathodic protection device of claim 1, wherein a grounding electrode is secured to the terminal, the grounding electrode pierced by a metal rod, externally insulated, and water tight, the grounding electrode insertable in a water pipe network which supplies water to a ship engine or other cooling installation at a point allowing water to constantly and uninterruptedly run over the grounding electrode.

5. The autonomous impressed cathodic protection device of claim 1, wherein the device is configured to impose up to −1.6 volts (V) to a metal surface.

6. The autonomous impressed cathodic protection device of claim 1, wherein the device is configured to provide cathodic protection for up to five years of continual use.

7. A method of manufacturing an autonomous impressed cathodic protection device, comprising:

placing a soft, spongy, foamed material over a copper sheet;

placing a magnesium anode sheet over the foamed material;

coiling the magnesium anode sheet, the copper sheet, and the foamed material in a spiral pattern;

inserting the coiled magnesium anode sheet, copper sheet, and foamed material in a plastic container along with a central magnesium anode core; and filling a hollow space within the plastic container with an inert material, wherein the spiral pattern of the coiled magnesium anode sheet, copper sheet, and foamed material extends around the central magnesium anode core more than three complete revolutions.

8. The method of claim 7, further comprising attaching a connection wire to both the central magnesium anode core and the magnesium anode sheet, the connection wire extending from the plastic container and attachable to a protected surface.

9. The method of claim 7, further comprising securing a terminal to the copper sheet, the terminal attachable to a grounding apparatus.

10. The method of 7, wherein the autonomous impressed cathodic protection device comprises:

the central magnesium anode core;

a spiral structure comprising the magnesium anode sheet, the copper sheet, and the foamed material formed in the spiral pattern with the foamed material positioned between the magnesium anode sheet and the copper sheet to maintain a constant distance between the magnesium anode sheet and the copper sheet all along the spiral pattern, the foamed material acting as an electrical insulator and waste absorber;

the plastic container;

a connection wire secured to both the central magnesium anode core and the magnesium anode sheet, the connection cable extending from the plastic container and attachable to a protected surface; and a terminal secured to the copper sheet, the terminal attachable to a grounding apparatus.

* * * * *